US010322334B2

(12) United States Patent
Jones

(10) Patent No.: US 10,322,334 B2
(45) Date of Patent: Jun. 18, 2019

(54) SPINNING WHEEL WITHOUT FIXED INDICIA

(71) Applicant: Mark Hamilton Jones and Sheryle Lynn Jones Family Trust dated Nov. 7, 2013, Gardnerville, NV (US)

(72) Inventor: Mark H. Jones, Gardnerville, NV (US)

(73) Assignee: Mark Hamilton Jones and Sheryle Lynn Jones Family Trust dated November 7, 2013, Gardnerville, NV (US)

( * ) Notice: Subject to any disclaimer, the term of this patent is extended or adjusted under 35 U.S.C. 154(b) by 0 days.

(21) Appl. No.: 15/719,469

(22) Filed: Sep. 28, 2017

(65) Prior Publication Data

US 2019/0091560 A1 Mar. 28, 2019

(51) Int. Cl.
*A63F 5/00* (2006.01)
*G07F 17/32* (2006.01)

(52) U.S. Cl.
CPC ..... *A63F 5/007* (2013.01); *A63F 5/0011* (2013.01); *G07F 17/3211* (2013.01); *G07F 17/3244* (2013.01); *G07F 17/3286* (2013.01)

(58) Field of Classification Search
CPC ..... G07F 17/321; G07F 17/3286
See application file for complete search history.

(56) References Cited

U.S. PATENT DOCUMENTS

| | | | | |
|---|---|---|---|---|
| 7,669,853 | B2 * | 3/2010 | Jones | A63F 1/12 273/142 JA |
| 9,757,641 | B2 * | 9/2017 | Jones | A63F 1/12 |
| 2008/0073842 | A1 * | 3/2008 | Jones | A63F 1/12 273/149 R |
| 2010/0120488 | A1 * | 5/2010 | Savytskyy | G07F 17/32 463/17 |
| 2014/0246829 | A1 * | 9/2014 | Jones | A63F 1/12 273/149 R |

* cited by examiner

*Primary Examiner* — Jay Trent Liddle
*Assistant Examiner* — Alex F. R. P. Rada, II
(74) *Attorney, Agent, or Firm* — John S. Artz; Dickinson Wright PLLC

(57) ABSTRACT

A shuffling machine for use with a game of chance having a plurality of possible outcomes includes a base structure and a wheel portion in communication with the base structure. The wheel portion includes a plurality of discrete areas corresponding in number to the plurality of possible outcomes for the game of chance. Each of the plurality of areas includes a plurality of displays configured to show an indicia corresponding to one of the plurality of possible outcomes. The machine includes a selector for identifying one of the plurality of areas and the indicia associated with the identified one of the plurality of areas. Wherein the plurality of indicia are not fixed such that they are not permanently assigned to one of the plurality of areas.

21 Claims, 3 Drawing Sheets

SPINNING WHEEL WITHOUT FIXED INDICIA

BACKGROUND OF THE INVENTION

1. Field of the Invention

The present disclosure relates generally to a game of chance and more particularly to a spinning wheel wherein there are no fixed indicia for determining a game outcome.

2. Description of the Prior Art

Games of chance are well known activities whose outcomes are strongly influenced by randomizing devices upon which contestants may wager money as they forecast outcomes. Common randomizing devices include dice, spinning wheel assemblies, playing cards, prize wheels, and numbered balls drawn from containers. The use of spinning wheel assemblies to generate an outcome for a game of chance has become particularly popular to players. One common example is a roulette wheel, wherein a spinning wheel having a plurality of indicia with corresponding pockets is spun. After the spinning wheel is spun, a game ball may be introduced to the spinning table, often times spun around a rim in the opposite direction than the spinning wheel is spun. During this period of time, players can wager on which ball pocket the ball will come to rest in. Other forms of roulette wheels incorporate cards and pointers, these differences in roulette wheels can be based on preference, region, or local gaming rules. Nonetheless, roulette and most other games of chance that incorporate spinning wheels include a base portion that the spinning wheel is mechanically connected to and which the wheel spins relative to.

It is an unavoidable, and a necessary part of the game, that this mechanical connection between the wheel and base bias the wheel from spinning indefinitely. Or in the alternative, that the pointer, e.g., detent or flange biases the spinning wheel causing it to stop to determine a game outcome. As a result, very skilled players or dealers may be able to track certain wheel profiles after over time. Such predictability is undesirable in a game of chance. It is important that randomizing devices operate in a truly random manner to ensure integrity of the games with which they are used. This ensures that the odds associated with particular wagers are accurate and also helps minimize the potential for cheating. In addition to a predicable bias between the wheel and the base, randomizing devices can also exhibit patterns over time with a bias for certain stopping points that occur more frequently than others. This is known to result from the rotary components developing wear patterns that can cause increased friction at certain stopping points. This condition is undesirable and can cost casinos significant revenue each year as it changes the odds of the game and allows a player of the game to anticipate a particular outcome or could even allow a dealer to influence the game as incentivized by tips. Accordingly, there is a desire to add increased performance life and unpredictability to games of chance that incorporate a spinning wheel without losing player interest.

SUMMARY OF THE DISCLOSURE

It is therefore an aspect of the present disclosure to provide a spinning wheel for use with a game of chance that provides increased performance life.

It is another aspect of the present disclosure to provide a spinning wheel for use with a game of chance with increased randomization.

It is yet another aspect of the present disclosure to provide a spinning wheel for use with a game of chance with novel and enticing game types.

In accordance with the above and other aspects of the present disclosure, an improved spinning wheel assembly is provided. The spinning wheel assembly includes a base and a spinning wheel. The spinning wheel and base form a mechanical connection allowing the spinning wheel to spin relative to the base. The spinning wheel includes a plurality of fixed indicia related to a decision for a game of chance. A gaming element, which can be either a gaming ball, a detent or the like may be used in conjunction with the plurality of fixed indicia to provide an outcome for a game of chance, specifically, locating the position of the gaming element relative to the fixed indicia once the spinning wheel has stopped spinning. The spinning wheel can include indicia whose location is not fixed on the wheel. In other words, the areas designated on the wheel to illustrate indicia move mechanically, or switch electronically by a randomizer eliminating any chance of biasing predictability and also extending performance life.

As it should be appreciated, the subject disclosure provides for a method of playing a game with the spinning wheel assembly. The dealer, or gaming operator, can collect wagers from at least one player based on traditional criteria related to the indicia, for example ending location of the indicia relative to the gaming element. Once wagers have been placed, the dealer can spin the wheel and the players who predicted the ending location of the gaming element relative to the indicia win. The payouts for wagers are typically scaled as a function of probability of the player wager. In other words, if the player predicts a very specific relationship to the fixed indicia and the gaming element that has a smaller probability of occurring, then the player stands to get a higher percentage payout of their wager. After a predetermined or random threshold, the indicia on the wheel can be rearranged to eliminate any chance of predictability. This rearranging can be accomplished by 100% random positioning or based on simply indexing the indicia forward or backward to a different location, but maintaining the indicia in the same order. The indicia can be displayed as a number, a card, any object or the like.

BRIEF DESCRIPTION OF THE DRAWINGS

Other aspects of the present disclosure will be readily appreciated, as the same becomes better understood by reference to the following detailed description when considered in connection with the accompanying drawings wherein.

BRIEF DESCRIPTION OF THE DISCLOSURE

Figure 1:
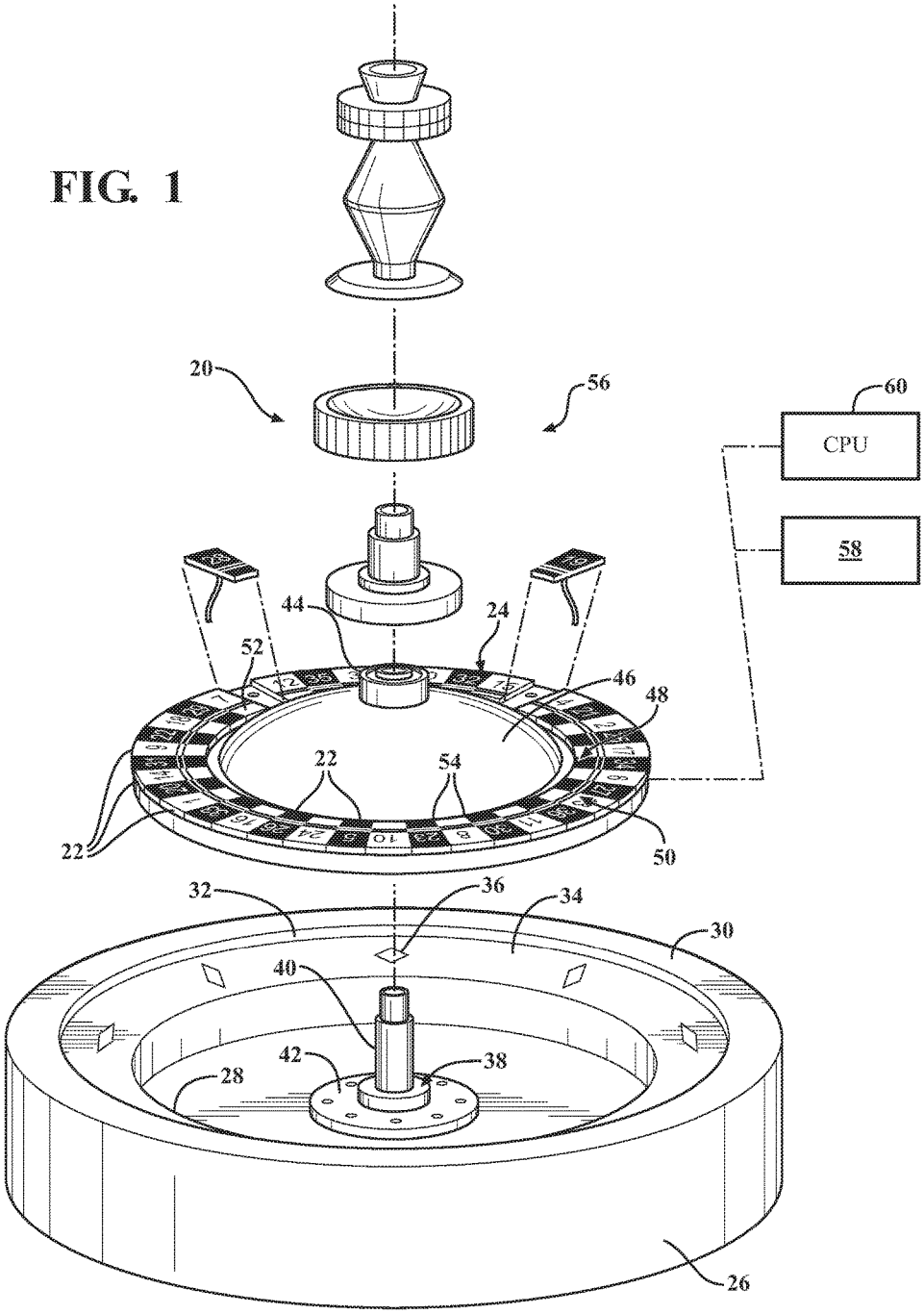
FIG. 1 is an exploded view of one aspect of the present disclosure.

Referring to the Figures, wherein like numerals indicate corresponding parts throughout the several views, a spinning wheel assembly 20 that rearranges indicia 22 in a game of chance is generally shown in FIG. 1. The spinning wheel assembly 20 can include a spinning wheel 24 and a base 26.

The spinning wheel 24 may be cradled on top of the base 26; however, it should be appreciated that the cradle could also hang under the base 26. Other arrangements between the base 26 and the wheel 24 may be employed. According to one aspect, the base 26 may be bowl shaped and include a bottom circular portion 28 that includes an outer edge. A rim portion 30 can extend axially from the outer edge of the base and can define an upper ball track 32 and a lower ball track 34. The lower ball track 34 may be sloped downwardly and may include one or more ball deflectors 36 of various shapes. A mechanical connection 38 can extend from the center of the bottom circular portion 28 and typically includes a spindle element 40 and a lower bearing 42. According to an aspect, the spinning wheel 24 may include a central upper bearing 44 for mechanical connection 38 to the spindle and lower bearing 42. According to an aspect, the upper and lower bearings 44, 42 can allow the spinning wheel 24 to freely rotate about the spindle relative to the base 26. However, it should be appreciated that any connection between the base 26 and spinning wheel 24 could be incorporated without departing from the present disclosure. Weight may be added on top of the spinning wheel 24 in the form of a weighted turret that spins unitarily with the spinning wheel 24 and provides additional centrifugal force to keep the spinning wheel 24 in rotation. It will be appreciated that the base 26 may take on a variety of different configurations.

In one aspect, the spinning wheel 24 can include a convexly-shaped central bulbous portion 46 extending radially outwardly to a pocket section 48 and an indicia section 50. The pocket section 48 can include a plurality of recesses 52 being divided equally and circumferentially around the central bulbous portion 46 by guides 54. The indicia section 50 may include a plurality of indicia 22, wherein each indicia 22 of the plurality of indicia 22 correspond to and are spaced directly radially outwardly from, one of the recesses 52. The assembly further includes a gaming element 56, e.g., a ball wherein the resting position of the ball (which pocket it ends up in) is wagered on by a player. It will be appreciated that a variety of other gaming elements 56 may be employed such as a detent or fixed marker or pointer. During introduction, the ball may be placed in the upper ball track 32 and spun in the opposite direction as the spinning wheel 24. Centrifugal forces keep the ball along the upper ball track 32 until they diminish and the ball spirals downward towards one of the recesses 52.

The indicia 22 could include literally any marker that distinguishes it from the other indicia 22 and more than one indicia 22 could be paired or grouped together in association with one recess 52, for example numbers and colors. According to an aspect, the indicia section 50 may include a randomizer 58 which rearranges the indicia 22. The randomizer 58 can be electrically connected to a controller 60, such as a C.P.U. that can include programing to recognize specific thresholds whereafter a command is sent to the randomizer 58 to rearrange each of the indicia 22 or group of indicia 22. This connection between the controller 60 and the randomizer 58 is preferably wireless. For example, according to an aspect, the indicia 50 may be randomly assigned or rearranged once the round has begun, i.e., the wheel has been spun or the ball dropped. It will be appreciated that the indicia can be assigned in a variety of different ways. Moreover, according to an aspect, the randomizer and CPU could be integrated into a single structure.

Figure 2:
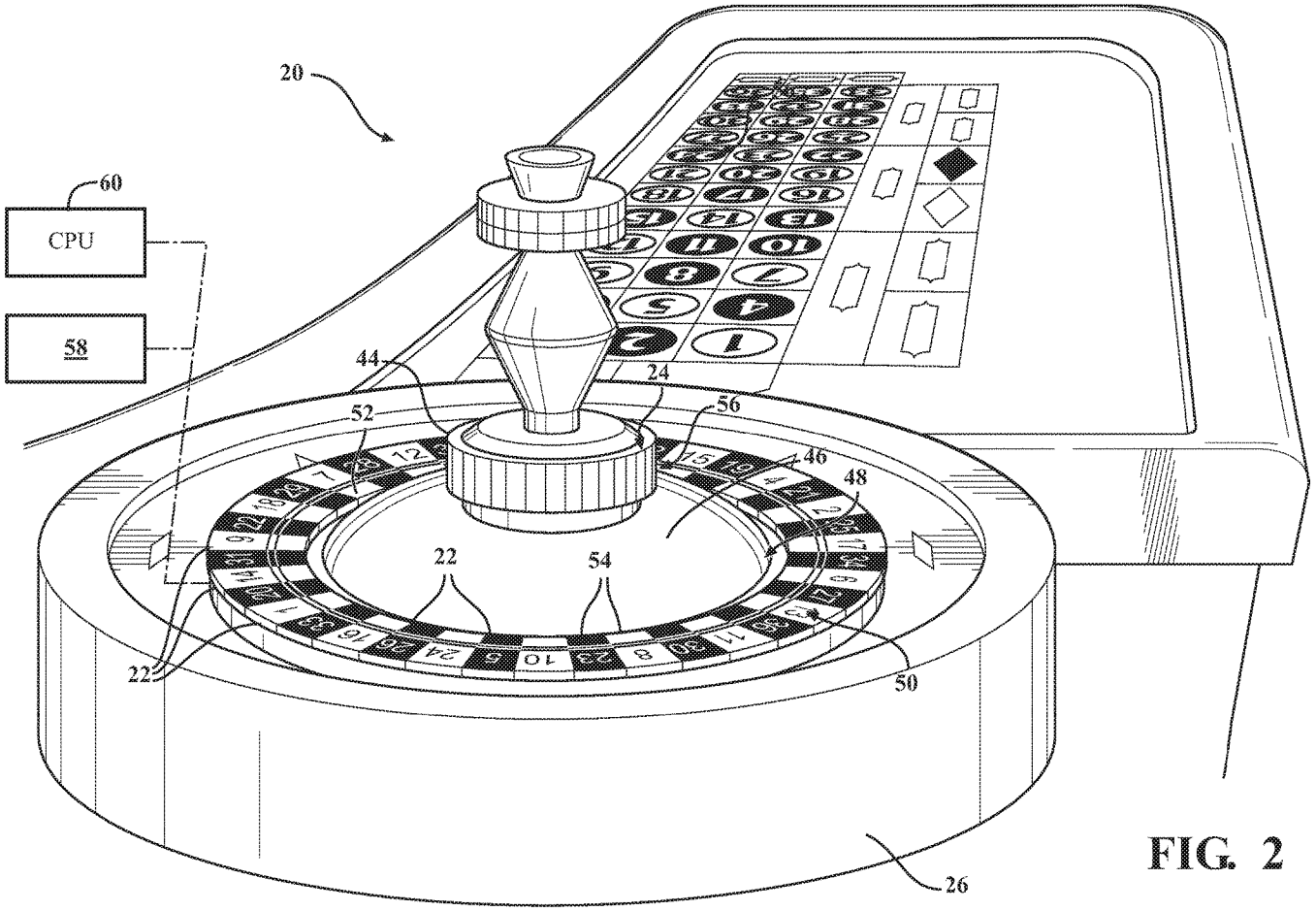
FIG. 2 is a perspective view of another aspect of the present disclosure.

FIG. 2 illustrates another wheel assembly 20 according to an aspect of the present disclosure. As shown, the assembly includes a base 26 and a wheel 24 one of which is rotatable with respect to the other. The wheel assembly 20 may be disposed on or adjacent a table having a playing surface. The playing surface can include a plurality of wagering areas thereon corresponding to different outcomes for the game of change. For example, the playing surface can have wagering areas corresponding to the game of roulette. However, the playing surface may have wagering areas corresponding to other games, such as craps or the like. According to an aspect, the wheel assembly 20 may have a variety of electronic displays 100 located thereon. In one aspect, the displays 100 may be located on a fixed portion such as a stationary center portion or the outer rim portion 30. It will be appreciated that the displays 100 may be located in a variety of other suitable locations, including in the pockets themselves. According to an aspect, the displays 100 may be configured to display an indicia 50 thereon, which indicia corresponds to an outcome of the game of chance as well as one of the wagering areas. Each display is associated with an area, recess or pocket 52 on the wheel 24. The number of areas, recesses or pockets 52 areas on the wheel 24 correspond to the number of outcomes as will be understood by one of ordinary skill. The apparatus for identifying a single recess 52 and thus indicia associated therewith may vary. For example, a ball may be utilized to select the recess or alternatively a detent may be utilized, wherein the detent also serves to slow rotation of the spinning wheel such as by interaction with structures on the wheel to apply a pulsating resistance. Alternatively, the wheel 24 may be electronically controlled such that its slows and stops under electronic control and a marker on a structure (such as the fixed base) may serve to identify the recess 52 that stops in spaced relationship to the marker.

It should be appreciated that to achieve complete unpredictability, the randomizer 58 can reorganize or reassign the indicia 22 to the various slots or pockets completely randomly. It will be appreciated that the indicia 22 may be randomly reassigned after each round. However, according to another aspect, a variety of other ways may be employed to organize or assign the indicia 22 that the players will find interesting and enticing. As just one example, if each indicia 22 includes a different number and one of two colors, the randomizer 58 could be programed to move all the colors together, all the even numbers together, or some combination thereof. In other words, some subsets of the total indicia may be reassigned before each round. Such reorganizations may be programed by the C.P.U. to occur at various times or may be preselected. According to another example, the indicia 22 can me moved or indexed in other direction such that order of the indicia 22 remain the same, but the location to where they are assigned may be randomly selected. The randomizer 58 could change the indicia 22 in several different ways. In one aspect, the indicia 22 may be displayed on electrical screens, wherein the portion displaying the indicia 22 does not move, and only the electrical screen changes what is displayed. The electrical screen could be digital or any other form of electrical screen known to display changeable images. According to another aspect, the randomizer 58 may mechanically change the position of the indicia 22, for example, much like a pin setter used in bowling applications, the randomizer 58 would remove several independent portions that display indicia 22 from the spinning wheel 24 and rearrange them, before distributing them back onto the spinning wheel 24. In yet another embodiment, each displayed indicia 22 could be just one on a reel or rack of a plurality of indicia 22 that revolve or flip in accordance with a programed command. It will also be appreciated that any indicia may be used including numbers, colors, playing cards or any other object or image.

Figure 3:
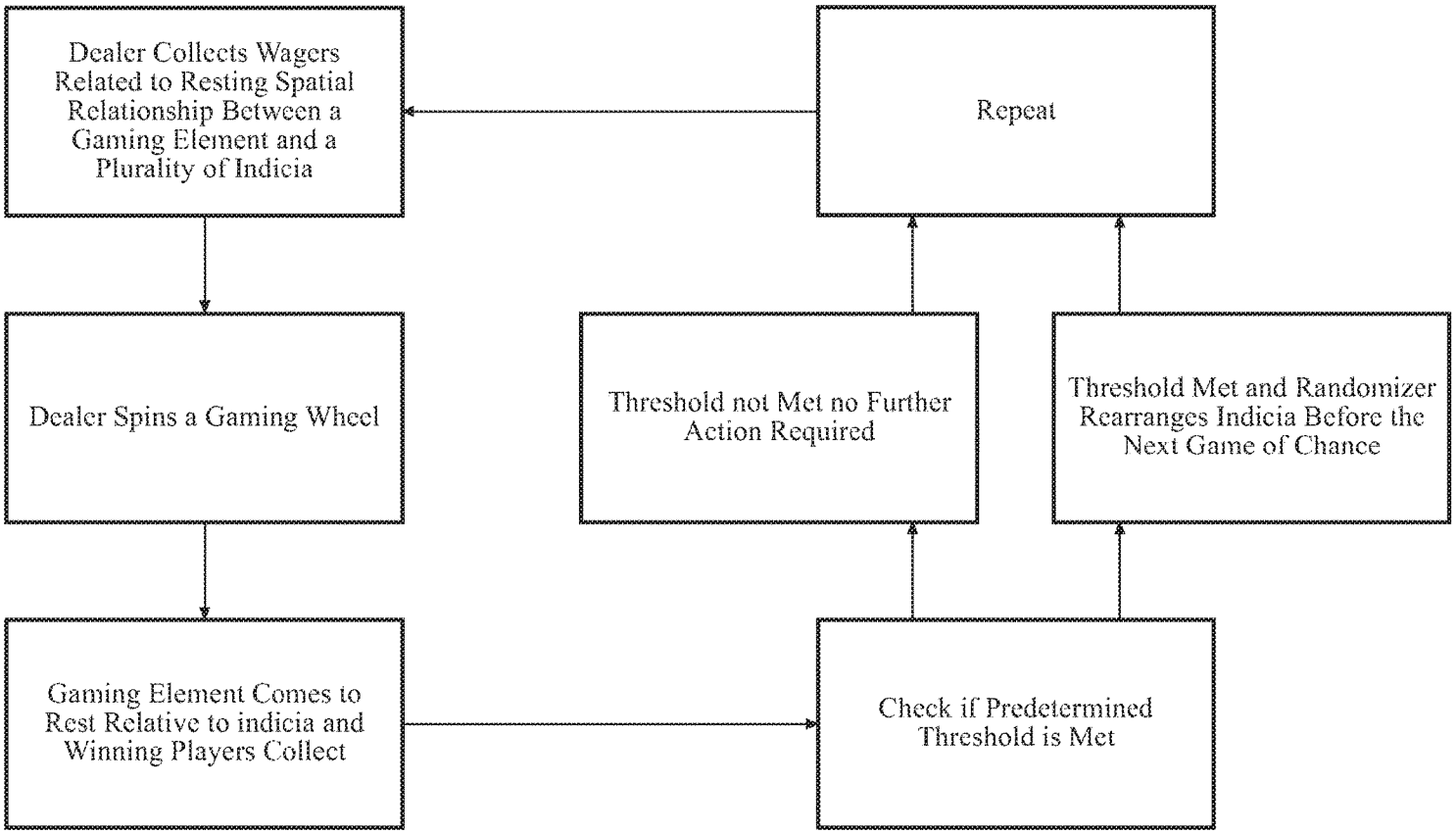
FIG. 3 is a method chart in accordance with one aspect of playing according to the present disclosure.

In light of the foregoing, the spinning wheel assembly 20 can also include a method of playing a game using same as described with reference to FIG. 3. According to an aspect, the dealer, or gaming operator, can collecs wagers from at least one player based on traditional criteria related to a resting spatial relationship between one or more indicia 22 on the spinning table, for example a number, a color, or both relative to a gaming element 56. Once wagers have been placed, the dealer can spin the spinning wheel 24 such that it interacts with the gaming element 56. As will be appreciated the rotation of the wheel 24 may be effected mechanically or under electronic control. As the spinning wheel 24 comes to a stop, the gaming element 56 rests relative to the one or more indicia 22 and the dealer pays out players based on a predetermined percentage. This predetermined percentage is generally based on the probability of success, wherein a wager with a lower probability of success will get a higher percentage than one with a higher probability of success.

After a predetermined or random threshold, the indicia 22 on the wheel rearrange completely randomly. This threshold can be based on time, the number of plays, or any other factors including a manual operation. For example, after each round of play, i.e., wager collection, spin, and payout, a randomizer 58 will rearrange all the indicia 22. However, the rearranging could happen at a variety of different intervals. If there is more than one paired indicia 22 marked on each portion, then the randomizer 58 can keep indicia 22 paired during reorganizing or may separate and re-pair during reorganizing. It should also be appreciated that the reorganizing could also occur in a period after the spinning wheel 24 has started to spin, wherein players may have a window of opportunity to place wagers, i.e. with each spin. As briefly mentioned above, the randomizer 58 may allocate a certain number to each indicia 22 or pair of indicia 22 and follow a random number generation command to reorganize each indicia 22 in a chaotic and totally unpredictable manner. The C.P.U. could also include additional programing to command the randomizer 58 to reorganize the indicia 22 into predetermined profiles. In light of the forgoing example mentioned previously, a predetermined profile could place odd numbers or colors together along the indicia 22 portion in order to entice players with novel indicia 22 layouts. Such predetermined profiles could be commanded in lieu of the random number generation or used in conjunction with it. For example, the predetermined profile command would attach a probability to each profile, wherein one of the profiles is random number generation. To this extent, the random number generation profile could have a much higher probability of being selected out of the other profiles and thus the game is played with relatively sequential total reorganization with periodic and rare additional profile commands. This could be achieved by having multiple standard profiles of the same random number generation and only singular profiles of the novel layouts, such that a command to randomly select a profile will be more likely to select one of the plurality of standard random number profiles than one of the singular novel layouts or "bonus rounds".

Obviously, many modifications and variations of the present invention are possible in light of the above teachings and may be practiced otherwise than as specifically described. In addition, the reference numerals are merely for convenience and are not to be read in any way as limiting. Note that not all of the activities described above in the general description or the examples are required, that a portion of a specific activity may not be required, and that one or more further activities may be performed in addition to those described. Still further, the orders in which activities are listed are not necessarily the order in which they are performed. The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Furthermore, certain features are, for clarity, described herein in the context of separate embodiments, may also be provided in combination in a single embodiment. Conversely, various features that are, for brevity, described in the context of a single embodiment, may also be provided separately or in any sub combination. Further, reference to values stated in ranges includes each and every value within that range.

What is claimed is:

1. A shuffling machine for use with a game of chance having a plurality of possible outcomes, comprising:

a base structure;

a wheel portion in communication with the base structure;

a plurality of discrete areas formed in the wheel portion, the plurality of areas corresponding in number to the plurality of possible outcomes for the game of chance;

a plurality of displays, each of the plurality of displays associated with one of the plurality of areas and configured to show an indicia corresponding to one of the plurality of possible outcomes;

a selector for identifying one of the plurality of areas and the indicia associated with the identified one of the plurality of areas; and wherein the plurality of indicia are not fixed such that they are not permanently assigned to one of the plurality of areas and are presented on electronic displays which are in communication with a gaming controller configured to randomly assign each of the plurality of indicia to a respective one of the plurality of displays after at least one of the plurality of possible outcomes has occurred.

2. The shuffling machine of claim 1, where the plurality of discrete areas consist of recesses.

3. The shuffling machine of claim 1, wherein the base structure and the wheel portion are a single integral structure.

4. The shuffling machine of claim 3, wherein the selector is a ball that can roll about the base portion and come to rest in one of the plurality of areas.

5. The shuffling machine of claim 1, wherein the base structure defines a vertical axis of rotation and wherein the wheel portion is rotatable about the generally vertical axis of rotation.

6. The shuffling machine of claim 5, wherein the selector comprises a detent in communication with the base and is configured to apply a pulsating force to slow rotation of the wheel in order to singulate the identified one of the plurality of areas.

7. The shuffling machine of claim 5, wherein the selector comprises a marker associated with the machine that singulates the identified one of the plurality of areas.

8. The shuffling machine of claim 1, wherein the gaming controller is configured to randomly assign the plurality of indicia to the plurality of displays after a multiple of the plurality of possible outcomes has occurred.

9. The shuffling machine of claim 1, wherein the gaming controller is configured to randomly assign each of the plurality of indicia to a respective one of the plurality of displays while maintaining a sequence of the plurality of indicia in the plurality of areas from before a preceding game outcome was determined.

10. The shuffling machine of claim 1, wherein the plurality of indicia are physically affixed to and removeable from the machine.

11. The shuffling machine of claim 1, wherein the gaming controller is in communication with each of the displays, the gaming controller configured to randomly assign each of the plurality of indicia to a respective one of the plurality of displays while maintaining a sequence of the plurality of indicia in the plurality of areas from before a preceding game outcome was determined.

12. A shuffling machine for use with a game of chance having a plurality of possible game outcomes, comprising:

a base structure configured to support the machine, the base structure having an outer rim portion;

a bowl portion in communication with the base structure;

a plurality of discrete areas formed in the machine, each of the plurality of areas being associated with one of a plurality a unique indicia each corresponding to one of the plurality of possible game outcomes;

a selector for identifying one of the plurality of indicia with the identified one of the plurality of indicia representing the game outcome for one round;

wherein the plurality of indicia may be associated with different ones of the plurality of discrete areas for another round and appear on a display associated with each of the discrete areas; and a gaming controller in communication with each of the displays, the gaming controller configured to randomly assign the plurality of indicia to the plurality of displays after at least one of the plurality of possible outcomes has occurred.

13. The shuffling machine of claim 12, wherein the base structure defines a generally vertical axis of rotation.

14. The shuffling machine of claim 13, wherein the bowl portion consists of a wheel that is rotatable with respect to the base structure about the generally vertical axis of rotation.

15. The shuffling machine of claim 14, wherein the selector comprises a detent in communication with the base structure and configured to apply a pulsating force to slow rotation of the wheel in order to singulate the identified one of the plurality of areas.

16. The shuffling machine of claim 12, wherein the indicia are printed on removable structures.

17. The shuffling machine of claim 12, wherein each of the displays is disposed on the outer rim of the base structure.

18. The shuffling machine of claim 12, wherein the plurality of discrete areas consist of recesses.

19. The shuffling machine of claim 18, wherein the selector is a ball that can roll around the bowl portion and come to rest in one of the plurality of recesses.

20. The shuffling machine of claim 17, wherein the displays are located on an inner wall of the bowl portion.

21. A shuffling machine for use with a game of chance having a plurality of possible outcomes, comprising:

a base structure;

a wheel portion in communication with the base structure;

a plurality of discrete areas formed in the wheel portion, the plurality of areas corresponding in number to the plurality of possible outcomes for the game of chance;

a plurality of displays, each of the plurality of displays associated with one of the plurality of areas and configured to show an indicia corresponding to one of the plurality of possible outcomes;

a selector for identifying one of the plurality of areas and the indicia associated with the identified one of the plurality of areas;

wherein the plurality of indicia are not fixed such that they are not permanently assigned to one of the plurality of areas and are presented on electronic displays which are in communication with a gaming controller; and wherein the gaming controller is configured to randomly assign each of the plurality of indicia to a respective one of the plurality of displays while maintaining a sequence of the plurality of indicia in the plurality of areas from before a preceding game outcome was determined.

* * * * *